United States Patent [19]

Dornauer

[11] Patent Number: 4,736,181

[45] Date of Patent: Apr. 5, 1988

[54] FUSE LINK

[75] Inventor: Rainer Dornauer, Berwick, Australia

[73] Assignee: Morlynn Ceramics Pty. Ltd., Victoria, Australia

[21] Appl. No.: 18,059

[22] Filed: Feb. 24, 1987

[30] Foreign Application Priority Data

Feb. 28, 1986 [AU] Australia ..... PH4833

[51] Int. Cl.[4] ..... H01H 39/00; H01H 85/04

[52] U.S. Cl. ..... 337/203; 337/217; 337/291

[58] Field of Search ..... 337/203, 217, 274, 291, 337/246, 247, 249, 250

[56] References Cited

U.S. PATENT DOCUMENTS

| | | | |
|---|---|---|---|
| 2,174,767 | 10/1939 | Triplett et al. | 337/291 |
| 2,750,470 | 6/1956 | McBride | 337/217 |
| 3,344,251 | 9/1967 | Misare | 337/203 |
| 3,374,329 | 3/1968 | Bronikowski | 337/203 |
| 3,735,315 | 5/1973 | Swarbrick et al. | 337/290 |

*Primary Examiner*—H. Broome

*Attorney, Agent, or Firm*—Merchant, Gould, Smith, Edell, Welter & Schmidt

[57] ABSTRACT

A fuse link for an expulsion fuse used in connection with high voltage electrical transmission lines. The fuse link has an outer assembly in the form of a tube, a fuse element housed within the outer assembly, electrical connecting means serially connected to the fuse element to provide an electrical current path therethrough and, an arc-quenching medium, such as boric acid, contained within the outer assembly and in close proximity to the fuse element. In use, when the fuse element fuses due to excessive current a portion of the electrical connecting means is expelled from the outer assembly and the arc-quenching medium acts to inhibit a discharge of sparks due to arcing. The fuse element may comprise one or more fuse wires capable of withstanding a tensile force applied to it prior to fusing. Inhibiting any discharge of sparks is important to prevent accidental starting of fires particularly in forested areas.

5 Claims, 3 Drawing Sheets

FUSE LINK

This invention relates to a fuse link, and more particularly but not exclusively, to a fuse link incorporated in an expulsion fuse for use in connection with high voltage electrical transmission lines.

It is the practice with high voltage transmission lines to incorporate expulsion fuses across selected insulators from which electrical transmission cables or wires are suspended. An expulsion fuse consists of a fuse carrier formed from a hollow tube through which a fuse link passes which is adapted to be in electrical conducting relationship with the electrical cables or wires at either end of the tube. The lower end of the fuse carrier when installed is open to allow the tail at one end of the fuse link to pass therethrough, whilst the upper end of the fuse carrier carries a top casting with which the other end of the fuse link is mechanicaly connected in electrical conducting relationship.

The expulsion fuse is arranged so that a tensile force is normally applied to the fuse link between the fuse tail and other fixed end of the fuse link, whereby when the fuse link fuses, the fuse tail is expelled to ensure that an open circuit occurs. The configuration and operation of expulsion fuses is well known in the art and a further description will not be included herein. An example of such an expulsion fuse is described in copending Australian Patent No. 55261/86.

A prior art fuse link for an expulsion fuse is illustrated in FIGS. 1 and 2 shown slightly smaller than actual size. With reference to FIG. 1 there is shown a fuse link comprising an outer assembly 10 which consists of a nylon tube having a screw head terminal 12 attached to one end thereof. Outer assembly 10 houses electrical connecting means 14 having a first portion connected to the screw head terminal 12 and a second portion protruding from the other end of the outer assembly 10. The connecting means 14 typically comprises two lengths of ⅛ inch diameter brass tubing. Between the first and second portions of the connecting means 14 there is provided a strain element 16 having a fuse wire 17 wound thereon. Strain element 16 is typically made of terelene cord and fuse wire 17 is typically made of a tin/lead alloy. The portion of the connecting means 14 protruding from the end of the outer assembly 10, has a fuse tail 15, which consists of a tinned copper flexible cable, connected thereto. There may also be provided an insulating tube 11 surrounding the protruding portion of connecting means 14 and the cable 15 in order to prevent flashback of the discharge arc produced when the fuse blows. Brass ring 13 provides a crimp connection for fastening the tube 11 to the protruding portion of the connecting means 14.

Referring to FIG. 2 there is shown an enlarged partial-cutaway view of a portion of the fuse link of Figure 1. In FIG. 2 it can be seen more clearly that the fuse tail 15 and the protruding portion of the connecting means 14 are joined by means of a joint terminal 19 which is crimped to the fuse tail 15 and connecting means 14 respectively. The strain element 16, having fuse wire 17 wound thereon, can also be seen more clearly, serially connected between the first and second portions of the connecting means 14. Strain element 16 and fuse wire 17 are typically held in the end of the respective portions of connecting means 14 by crimping of the ends of the brass tubing. In this manner an electrical current path is provided through the fuse link from the terminal 12, through the first portion of connecting means 14, through fuse wire 17, and through the second portion of connecting means 14 to the fuse tail 15.

In use, when fuse wire 17 is subjected to excessive current it fuses and the heat generated due to the fusing and the consequent arcing between the first and second portions of the connecting means 14, severs the strain element 16 which is under strain due to a tensile force applied to the fuse link by the expulsion fuse arrangement. Consequently, the fuse tail 15 and the second portion of the connecting means 14 are expelled from the outer assembly 10 of the fuse link to establish an open circuit. In FIG. 2 there is also shown an inner nylon tube 18 coaxially surrounding the connecting means 14, the fuse wire 17 and strain element 16. Tube 18 is fastened to the protruding portion of connecting means 14 by the action of crimping ring 13. Nylon tube 18 is provided in order to limit the volume of air entering the outer assembly 10 when the fuse tail is expelled and thereby minimize the arcing that occurs at higher current levels.

A number of disadvantages of the prior art fuse link illustrated in FIGS. 1 and 2 have become evident in practice. Firstly, both before and during installation in an expulsion fuse by linesmen, it has been found that the tail 15 of the fuse link is often subjected to twisting. Rotation of the tail 15 is transferred to the protruding portion of the connecting means 14, which is in turn connected to the strain element 16 and the fuse wire 17. The fuse wire 17, made of a tin/lead alloy, has a relatively low tensile strength and therefore it requires only a few turns of the tail 15 in order to break the fuse wire 17. However, the strain element 16 made of terelene cord is quite capable of withstanding a number of turns and would not normally break. Therefore the linesmen installing the fuse link has no way of knowing that the fuse link is no longer operative as the protruding portion of the connecting means 14 is still held firmly by the strain element 16.

Another disadvantage of prior art fuse links used in expulsion fuses has been the tendency to release a shower of sparks when a fuse blows. It will be appreciated that such a release of sparks may be hazardous, particularly where the fuse is located on transmission lines passing through bushland where there is a high fire danger. Various attempts have been made to modify the design of expulsion fuses and fuse links in order to minimize the release of sparks and produce a so-called sparkless fuse. These include the provision of various forms of shielding surrounding the fuse to capture any sparks which may be released when the fuse link blows. Another approach has been to select a material for the fuse wire 17 which would fuse in such a manner that the release of sparks due to arcing between the respective portions of the connecting means 14 was minimized. However these methods have only met with limited success and there remains a window in the current rating of the fuses, between approximately 30 ampere to 60 ampere, where there is still substantial release of sparks due to arcing when the fuse blows under a condition of excessive current.

It is therefore an object of the present invention to attempt to overcome one or more of the above disadvantages of prior art fuse links.

In accordance with a first aspect of the present invention there is provided a fuse link for an expulsion fuse, said fuse link comprising;

an outer assembly comprising an elongate tube having an insert at one end and the other end being open;

an inner assembly comprising an elongate tube arranged coaxially with, and having an outer diameter which is smaller than the inner diameter of, said outer assembly tube;

a fuse element housed within said inner assembly;

electrical connecting means comprising a first portion and a second portion serially connected, with said fuse element therebetween, for providing a current path through said fuse element, said first portion being fixedly held within the outer assembly tube by said insert, said second portion having said inner assembly tube sealingly connected at one end thereto; and, an arc-quenching medium contained within said inner assembly tube and in close proximity to said fuse element whereby, in use, when said fuse element fuses due to excessive current, and said second portion of the electrical connecting means with said inner assembly tube connected thereto is expelled from the open end of the outer assembly tube, said arc-quenching medium inhibits a discharge of sparks due to arcing, wherein said inner assembly tube is connected to the second portion of the connecting means with a fastener having a portion with a transverse dimension which is greater than the inner diameter of said outer assembly tube, and wherein the open end of said outer assembly tube is provided with a slot to receive said fastener portion whereby the second portion of the connecting means is prevented from rotating prior to expulsion.

In a preferred embodiment of the fuse link there is further provided an inner assembly housed within said outer assembly, and coaxial with said fuse element, for containing said arc-quenching medium. Preferably, said arc-quenching material is comprised of at least 70% boric acid.

In a preferred embodiment when the current rating of the fuse element is to be in excess of the current withstand level of said strain wire there is provided a second wire connected in parallel with said strain wire, said second wire having a higher conductivity than said strain wire, whereby the current withstand level of said fuse element is increased.

In order that the invention may be more clearly ascertained several preferred embodiments of the fuse link will now be described, by way of example only, with reference to the accompanying drawings in which.

Figure 1:
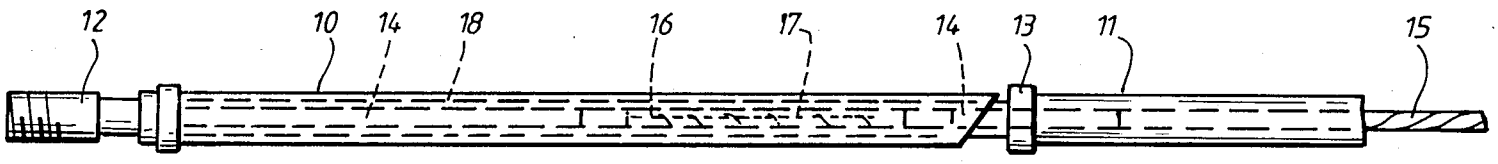
FIG. 1. PRIOR ART
FIG. 1 is a side view of a prior art fuse link.
Figure 2:
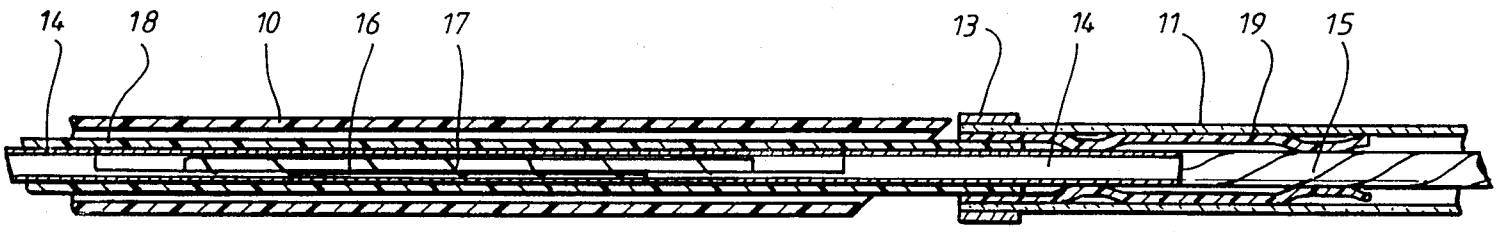
FIG. 2. PRIOR ART
FIG. 2 is a partial-cutaway view of a portion of the fuse link of FIG. 1.
Figure 3:
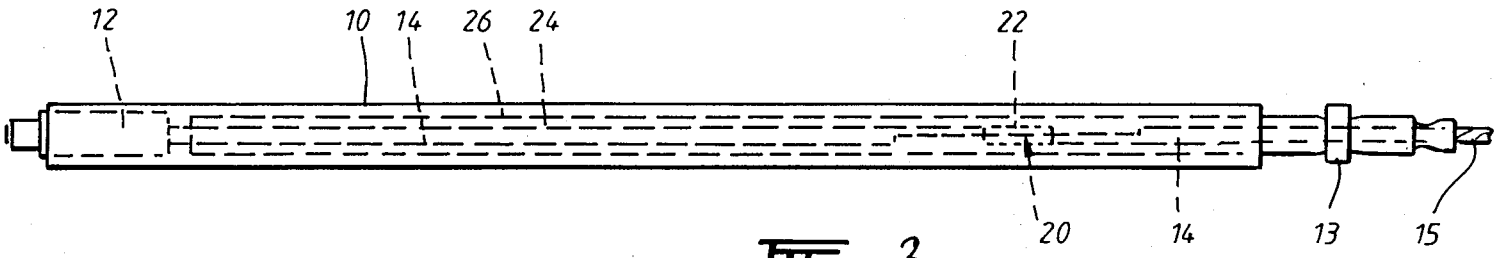
FIG. 3 is a side view of a first embodiment of a fuse link according to the invention.
Figure 4:
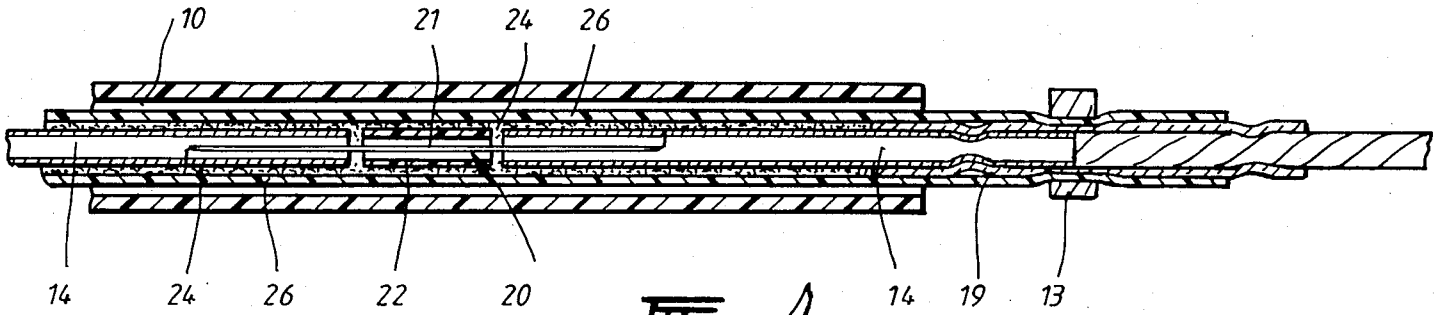
FIG. 4 is a partial-cutaway view of a portion of the fuse link of FIG. 3.

Referring to FIGS. 3 and 4 of the drawings there is shown a first preferred embodiment of a fuse link according to the present invention in which the like reference numerals refer to the same parts as in FIGS. 1 and 2. A comparison of the fuse link illustrated in FIGS. 1 and 2 with the fuse link illustrated in FIGS. 3 and 4 reveals that the most significant changes in the fuse link illustrated in FIGS. 3 and 4 are the provision of an arc-quenching medium 24 and of a fuse element 20 comprising strain wire 21.

Strain wire 21 replaces the strain element 16 and the fuse wire 17 of the prior art fuse link shown in FIG. 1, and is preferably made from nichrome wire. Nichrome wire has been chosen because it provides both adequate tensile strength and a predetermined melting point under current overload conditions. It will be appreciated that strain wire 21 is capable of withstanding a tensile force applied to it prior to fusing whereby the problem of breakage due to twisting of the fuse tail is substantially obviated. The strain wire 21 is connected to the respective ends of each length of brass tube comprising the first and second portions of the connecting means 14 by crimping. Surrounding the exposed portion of the strain wire 21 is a small diameter teflon sleeve 22 which is provided to restrict the volume of air surrounding the strain wire 20 and thereby inhibit arcing when the fuse blows as well as protecting the strain wire from corrosion. Teflon sleeve 22 also provides thermal insulation around the fuse element 20 whereby the rate of fusing is improved, particularly at low currents.

Referring to FIG. 4 there is illustrated an enlarged partial cutaway view of a portion of the fuse link of FIG. 3. In FIG. 4 it can be seen that an arc-quenching medium 24 is provided surrounding the fuse element 20 as well as a substantial length of the first and second portions of the connecting means 14. The arc-quenching medium 24 is contained within the outer assembly 10 by means of an inner assembly 26 comprising an elongate tube arranged coaxially with outer assembly 10 and connecting means 14, and having an outer diameter which is smaller than the inner diameter of the outer assembly tube. The inner assembly tube is sealingly connected at one end to the second portion of the connecting means 14 by crimping ring 13 so that when the fuse element 20 fuses, the inner assembly 26 is also expelled from outer assembly 10. Using teflon as the material from which the tube of inner assembly 26 is made has been found to result in less carbon deposition and less friction when the fuse blows and therefore results in a better separation of the two portions of the fuse link. Inner assembly 26 also functions similarly to the tube 18 of the prior art fuse link in sofar as it limits the entry of air (oxygen) into the outer assembly 10 when the fuse tail 15 is expelled and thereby minimizes the amount of arcing that occurs.

Arc-quenching medium 24 may be of any suitable flame retardant material and in particular boric acid has been found to be quite suitable. When the strain wire 21 fuses due to excessive current the small teflon sleeve 22 is consumed or expelled and as the two portions of connecting means 14 separate sparks produced due to arcing between the respective portions of the connecting means 14 are extinquished due to the presence of the boric acid. Boric acid produces an inert gas when subject to elevated temperatures such as occur due to the fusing and arcing with the fuse link under overload current conditions. A substantial length of the inner assembly tube extends over the first portion of the connecting means 14 and contains therein the arc-quenching medium 24 in particulated form. Therefore the gap between the respective ends of the first and second portions of the connecting means 14 is continuously supplied with arc-quenching medium 24 whilst the second portion is being expelled. When the free end of the inner assembly tube finally emerges from the outer assembly 10, arcing has ceased and substantially all of the sparks have been quenched.

Boric acid has been found to operate satisfactorily as an arc-quenching medium over the complete current range of about 2 ampere up to 63 ampere for fuse links used in this type of expulsion fuse. Under laboratory test conditions it has been found that even up to a short circuit breaking current of 600 ampere not all of the boric acid has been consumed and therefore reliable operation is anticipated at even higher breaking current levels. It is not necessary for the arc-quenching medium to contain 100% boric acid and indeed it is preferably to include other inert substances, such as silica sand, in order to reduce the overall cost of the fuse link. It has been found that between 70 and 100% boric acid with the remainder comprising silica sand has resulted in satisfactory performance of the arcquenching medium.

Using nichrome wire for the strain wire 21 of the fuse element 20 will provide satisfactory performance of the fuse link up to operating current levels of approximately 5 ampere. Above this current level a second fuse wire is provided connected in parallel with the nichrome wire, which fuse wire has a higher conductivity than the nichrome wire. A suitable material for the parallel fuse wire is silver wire. Because of the increased conductivity of the silver wire the parallel fuse wire will carry most of the current passing through the fuse link whilst the nichrome wire continues to provide the tensile strength. The actual current rating of the fuse element will be a function of the respective conductivities of the parallel connected nichrome wire and silver wire.

Following experimental trials of the fuse link illustrated in FIGS. 3 and 4 a number of limitations of this first embodiment were discovered particularly at higher current levels. In the second embodiment illustrated in FIGS. 5 and 6 these limitations were overcome and several further improvements to the design of the fuse link were incorporated. In the second preferred embodiment phosphur bronze wire was employed rather than nichrome wire for the strain wire 21 of fuse element 20. Phosphur bronze wire is preferred because it has a lower melting point temperature to that of nichrome wire. It was found that heat generated by the fuse element 20 prior to fusing using nichrome wire was damaging the inner assembly 26, and sometimes even outer assembly 10, and therefore impairing proper operation of the fuse link. The operating current range of the fuse link using a single phosphur bronze strain wire is about 2 to 10 ampere. By adding one or more parallel fuse wires to strain wire 21 the current rating of the fuse element 20 can be extended to cover the complete current range for this type of fuse link. Suitable metals for the parallel fuse wires are for example silver or various tin alloys. The tube of outer assembly 10 is preferably made from a fire resistant plastics material.

Figure 5:
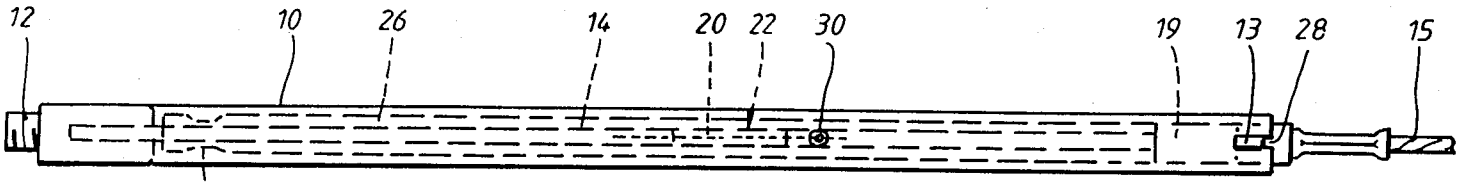
FIG. 5 is a side view of a second embodiment of a fuse link according to the invention; and, FIG. 6 is a partial-cutaway view of a portion of the fuse link of FIG. 5.

Referring to FIG. 5 it can be seen that the tube of inner assembly 26 is provided with a necked portion 27 of reduced diameter to aid in retaining the arc-quenching medium 24 within the inner assembly 26 both prior to use and during expulsion. When the fuse element 20 fuses and heat due to arcing is generated causing the production of gas from the boric acid, the pressure within the inner assembly 26 increases significantly and causes a jet of gas to be expelled from the free end of the tube of inner assembly 26.

Figure 6:
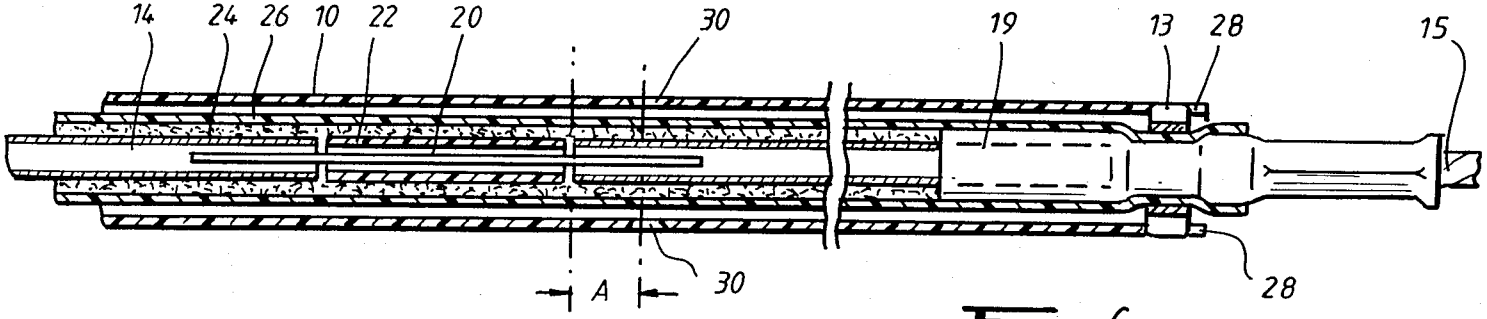

The jet of gas thus produced significantly increases the speed at which the second portion of the connecting means 14 is expelled from the outer assembly 10, so much so that the fuse tail 15 may actually fracture or separate from the joint terminal 19. Furthermore, at high breaking current levels, e.g. in excess of 1000 ampere; the rate at which the gas in produced may in fact be explosive and it was found desirable to provide some means of venting the gases produced without reducing the arc-quenching effect. For this purpose, the second embodiment illustrated in FIGS. 5 and 6 is provided with venting means 30 consisting of two holes, approximately 4 mm in diameter, provided in opposite sides of the tube of outer assembly 10. The position of the holes relative to the position of fuse element 20 is significant to allow gas to escape during the departure of the expelled portion of the fuse link without impairing its arc-quenching ability. The distance A indicated in FIG. 6, for this purpose, is preferably 5 mm.

A further improvement in the fuse link of FIGS. 5 and 6 is the provision of a slot 28 in the open end of the outer assembly tube which cooperates with a transverse portion of the crimping ring 13 to lock the second portion of the connecting means 14, and thus prevent rotation or twisting during handling.

Although in the above preferred embodiments an inner assembly 26 is provided to contain the arc-quenching medium 24, it will be obvious that other means for containing the arc-quenching medium 24 within the outer assembly 10 may be employed. For example, the arc-quenching medium 24 could be held within the outer assembly 10 by providing some form of seal at the open end of he tube of outer assembly 10 which is expelled with the second portion of the connecting means 14.

It will be apparent to persons skilled in the electric transmission arts that there are other practical embodiments of the present invention and that it is not limited to the preferred embodiments hereinbefore described. All such modifications and variations are considered within the scope of the present invention, the nature of which is to be determined from the foregoing description.

The claims defining the invention are as follows:

1. A fuse link for an expulsion fuse, said fuse link comprising:

an outer assembly comprising an elongate tube having an insert at one end and the other end being open;

an inner assembly comprising an elongate tube arranged coaxially with, and having an outer diameter which is smaller than the inner diameter of, said outer assembly tube;

a fuse element housed within said inner assembly;

electrical connecting means comprising a first portion and a second portion serially connected, with said fuse element therebetween, for providing a current path through said fuse element, said first portion being fixedly held within the outer assembly tube by said insert, said second portion having said inner assembly tube sealingly connected at one end thereto; and, an arc-quenching medium contained within said inner assembly tube and in close proximity to said fuse element whereby, in use, when said fuse element fuses due to excessive current, and said second portion of the electrical connecting means with said inner assembly tube connected thereto is expelled from the open end of the outer assembly tube, said arc-quenching medium inhibits a discharge of sparks due to arcing, wherein said inner assembly tube is connected to the second portion of the connecting means with a fastener having a portion with a transverse dimension which is greater than the inner diameter of said outer assembly tube, and wherein the open end of said outer assembly tube is provided with a slot to receive said fastener portion whereby the second portion of the connecting means is prevented from rotating prior to expulsion.

2. A fuse link as claimed in claim 1, wherein said arc-quenching medium comprises at least 70% boric acid.

3. A fuse link as claimed in claim 2, wherein said outer assembly tube is provided with means in the wall of the tube for venting gases produced when the fuse element fuses in use.

4. A fuse link as claimed in claim 3, wherein said means for venting gases consists of two apertures opposite to one another in the wall of the outer assembly tube.

5. A fuse link as claimed in claim 4, wherein said apertures are located 5 mm from the point where said fuse element connects to said second portion of the electrical connecting means prior to fusing.

* * * * *